US006035842A

United States Patent [19]

Bradley

[11] Patent Number: 6,035,842

[45] Date of Patent: Mar. 14, 2000

[54] ARROW STABILIZING MECHANISM FOR BOW AND ARROW

[76] Inventor: Michael M. Bradley, Rt. 1, Box 664. D, St. Albans, W. Va. 25177

[21] Appl. No.: 09/329,245

[22] Filed: Jun. 10, 1999

[51] Int. Cl.[7] ..... F41B 5/22

[52] U.S. Cl. ..... 124/44.5

[58] Field of Search ..... 124/23.1, 24.1, 124/44.5, 86

[56] References Cited

U.S. PATENT DOCUMENTS

| | | | |
|---|---|---|---|
| 2,483,928 | 10/1949 | Ott | 124/44.5 |
| 4,577,612 | 3/1986 | Zell | 124/44.5 |
| 4,949,699 | 8/1990 | Gerber | 124/44.5 |
| 5,181,502 | 1/1993 | Ray | 124/44.5 |
| 5,235,958 | 8/1993 | Laffin | 124/44.5 |
| 5,601,069 | 2/1997 | Clark | 124/44.5 |
| 5,611,323 | 3/1997 | Townley | 124/44.5 |
| 5,697,356 | 12/1997 | Chappell | 124/44.5 |

OTHER PUBLICATIONS

Bill Winke; Arrow Rest Selection, Bowhunting/Jun. 1998, pp. 72–76.

*Primary Examiner*—John A. Ricci

*Attorney, Agent, or Firm*—Jacobson, Price, Holman & Stern, PLLC

[57] ABSTRACT

A spring tension arrow stabilizing mechanism is provided with trigger-controlled disengagement. The arrow stabilizing mechanism includes a mounting bracket for attachment to a bow, an elongate rod rotatably mounted through the mounting bracket so as to have a forward end and a rearward end, a holding mechanism mounted on the rearward end of the rod, and a trigger mechanism pivotally mounted to the mounting bracket and attached to the forward end of the rod. The trigger mechanism has an at rest position and a pulled position. The holding mechanism has an engaged and a disengaged position, with the engaged position for stabilizing an arrow on the bow. A tension element biases the trigger mechanism into the at rest position and the holding mechanism into the engaged position. Pivoting of the trigger mechanism to the pulled position causes rotation of the elongate rod and thus the holding mechanism mounted thereon to the disengaged position.

16 Claims, 10 Drawing Sheets

ARROW STABILIZING MECHANISM FOR BOW AND ARROW

BACKGROUND OF THE INVENTION

1. Field of the Invention

The present invention is related to the field of archery and, more particularly, to a device for stabilizing a nocked arrow on the bow with the bow in both drawn and at rest positions.

2. Description of the Related Art

Bow hunting and target competitions using bows and arrows have become very popular, especially with compound bows. In hunting situations, where the hunter must be prepared to draw the bow with little time for preparation, it is common to keep the rear part of the arrow nocked, or mounted on the bow string, at all times. The forward part of the arrow is supported most typically on a bow rest. However, the arrow is susceptible to slipping off the rest, particularly if the hunter is moving or positioning for an awkward shot. Many hunters have experienced the agony of having their arrow fall from the arrow rest at the moment they draw to take a shot at game. Once the bow string has been drawn back it is not only difficult, but extremely dangerous, to "draw down" a nocked broadhead when the arrow has fallen off the rest. This can also be very frustrating as the hunter may, as a result of motion and/or noise involved in resetting the arrow, spook the game and lose the opportunity to take a shot for which the hunter has waited and worked a long time.

One approach hunters have used to secure the arrow is to hold the arrow against the bow using the forefinger. This can be tiring as the wrist must be placed in an unnatural position and may need to be held there for several hours while the hunter waits for game. This unnatural positioning also compromises the hunter's strength and stability, as the hunter cannot maintain the straight arm positioning which is optimal for shooting due to the rotation of the wrist necessary to hold the arrow with the forefinger.

Many devices have been developed to address these concerns. The device described in U.S. Pat. No. 5,601,069 teaches a retractable arrow rest mechanism activated by the movement of the arrow. The design includes a safety locking assembly which holds the arrow in position with respect to the arrow support. To take a shot, the safety locking assembly must be cleared using a thumb operated lever. The lever's direction of motion is counter to proper wrist and hand alignment on the bow which could compromise the accuracy of the shot. Other disadvantages include the mechanical complexity of the design, the distinctive click of the mechanism as it snaps clear, and the need to reset the mechanism after each shot.

U.S. Pat. No. 5,611,323 discloses an arrow retention device having a holding mechanism with closed and open positions. A release mechanism moves the holding mechanism between these positions. The release mechanism comprises a rotatable lever having a motion contrary to proper wrist and hand alignment on the bow. In addition to the alignment problem, the design is not adjustable and, because it incorporates its own rest, cannot simply be incorporated into a variety of existing bow set-ups.

Finally, U.S. Pat. No. 5,697,356 teaches an arrow holder having a trigger arm and a retaining wire mounted on a shaft. The shaft releasably engages the trigger arm so that, when the trigger arm is activated, the shaft is released and rotates away from the arrow. The location of the trigger is restricted by its method of mounting, and the process whereby the shaft is released creates unwanted noise and the need to reset the apparatus after every shot. Further, the design lacks the adjustability necessary to enable it to accommodate the variety of modern bow designs.

Each of these prior art designs mount opposite the arrow side of the bow, requiring them to be compatible with other accessories that necessarily also mount in this same area. The presence and location of such accessories restricts the range of adjustment available to the arrow holding devices. Additionally, the placement and operation of these prior art arrow holding mechanisms do not allow an arrow to be released effectively when such devices are engaged, due to interference of the mechanisms with arrow fletchings.

Other devices in the prior art, such as those disclosed in U.S. Pat. Nos. 5,235,958, 4,577,612, 4,949,699, and 2,483,928, represent solutions with limited application today, being largely incompatible with current bow designs. More particularly, modern bows typically rely upon an overdraw rest, enabling them to use shorter, and therefore lighter and faster, arrows. By shortening the arrows, the tip of the drawn broadhead is brought back and away from the front of the bow, and completely out of range of the workings of these prior art devices.

SUMMARY OF THE INVENTION

In view of the foregoing, one object of the present invention is to provide an arrow stabilizing mechanism that keeps the arrow secure against the bow through a variety of hunting conditions while allowing the hunter to comfortably and ergonomically control the precise position of the mechanism at any time during the act of shooting.

It is another object of the invention to provide an arrow stabilizing mechanism that is fully adjustable for use with virtually any bow and arrow configuration.

It is yet another object of the invention to provide an arrow stabilizing mechanism which is silent in operation and which does not have to be reset between shots.

It is still another object of the invention to provide such a mechanism which does not interfere with sights, rests, stabilizers or other accessories normally used with a bow.

It is a further object of the invention to provide an arrow stabilizing mechanism that is inexpensive and easy to use and repair.

A still further object of the invention is to provide an arrow stabilizing mechanism that will not interfere with arrow flight when the arrow is released with the mechanism engaged.

In accordance with this and other objects, a spring tension arrow stabilizing mechanism with trigger-controlled disengagement is provided. The arrow stabilizing mechanism is mounted with a mounting bracket to the front of the bow, just above the grip, where it does not interfere with other accessories such as rests, sights or stabilizers. A trigger, pivotally mounted to the mounting bracket, has an arm that extends downwardly from the mounting bracket such that the shooter can, with the grip hand, comfortably open one or more fingers to encircle the trigger arm. A rod extends rearwardly from the mounting bracket, toward the shooter, and supports a holding mechanism. The holding mechanism is biased into an engaged position where it is closely associated with the arrow shaft, preventing the arrow from falling off the rest. To disengage the holding mechanism, the user simply squeezes the trigger arm toward the grip.

A linkage between the trigger arm and the rod converts the pivoting of the trigger arm into rotation of the holding mechanism as mounted on the rod. To reengage the holding mechanism the user eases pressure on the trigger arm, allowing the rod and holding mechanism to rotate back into the engaged position. This process is smooth and silent and, because of the placement of the trigger arm, very easy to initiate. There is no need to "reset" the mechanism following disengagement, as the holding mechanism, responsive to spring tension, returns naturally to the engaged position upon release of the trigger arm. Additionally, the arrow may even be released with the holding mechanism in the engaged position without negatively impacting the flight of the arrow.

BRIEF DESCRIPTION OF THE DRAWINGS

The foregoing objects and other advantages of the present invention reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
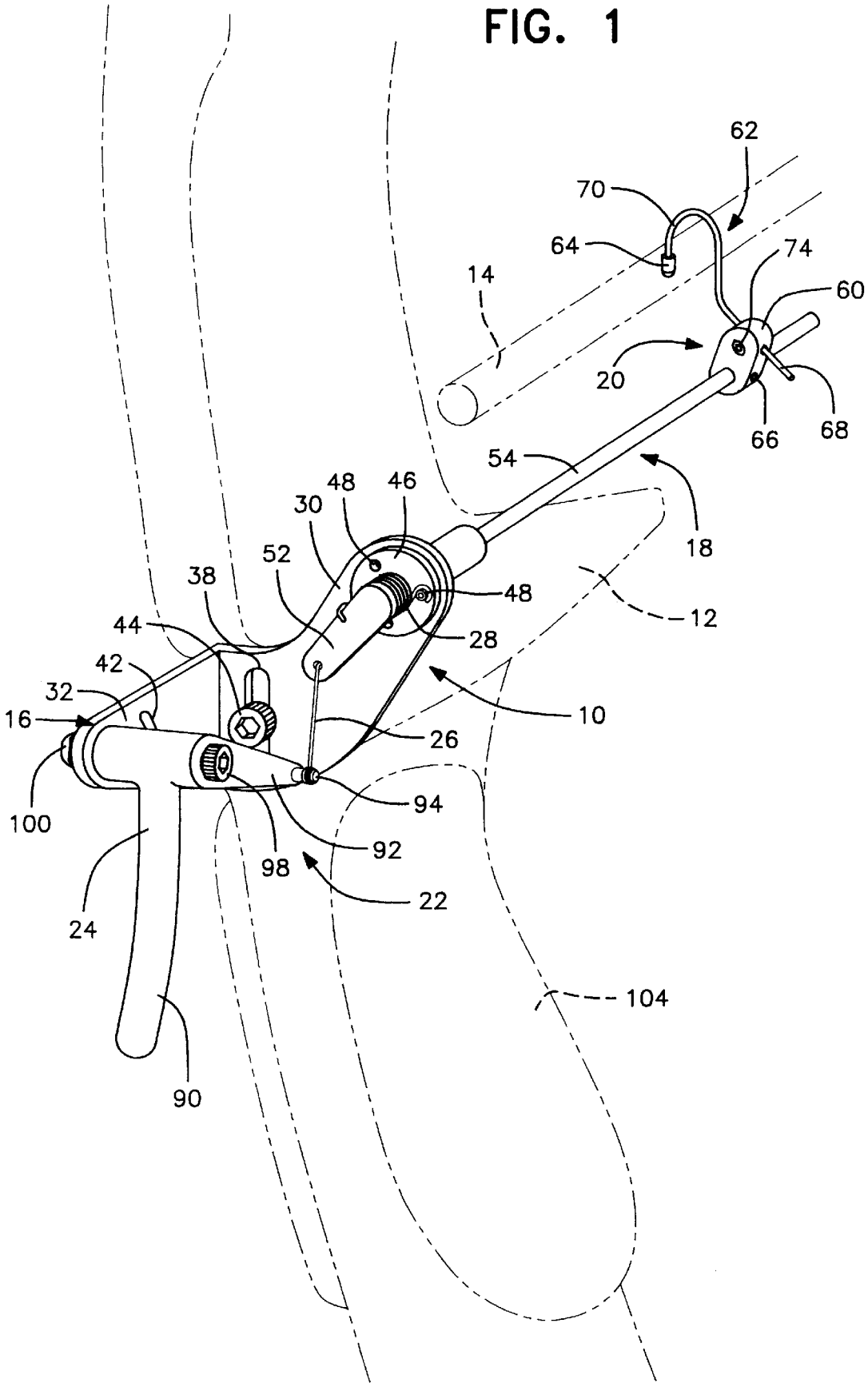
FIG. 1 is a front perspective view of the preferred embodiment of the arrow stabilizing mechanism of the present invention.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
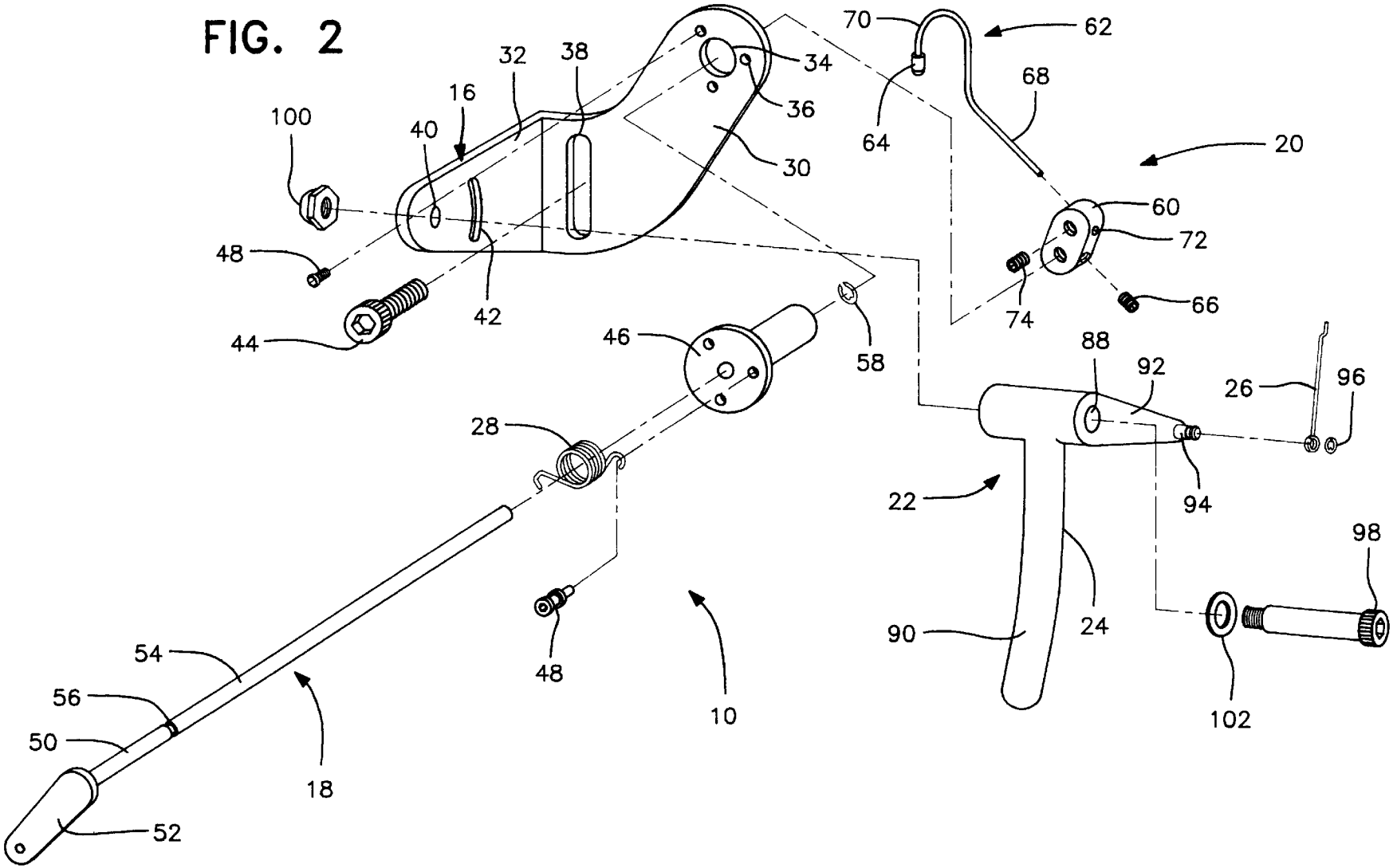
FIG. 2 is an exploded view of the elements shown in FIG. 1.

Referring now to FIG. 1, the preferred embodiment of the arrow stabilizing mechanism of the present invention is generally designated by the reference numeral 10. The bow 12 upon which the mechanism 10 is mounted and the shaft 14 of an arrow being stabilized are shown by phantom lines. An exploded view of the elements depicted in FIG. 1 is provided in FIG. 2.

The arrow stabilizing mechanism 10 includes a mounting bracket generally designated by the reference numeral 16, an elongate rod generally designated by the numeral 18, a holding mechanism generally designated by the numeral 20, and a trigger mechanism generally designated by the numeral 22. The trigger mechanism 22 includes a trigger 24, a push bar 26 and a tension element embodied as a spring 28.

The mounting bracket 16 has a mounting face 30 and a trigger mounting surface 32. The mounting face 30 is for attaching the bracket 16 to the bow 12. The trigger mounting surface 32 is for supporting the trigger mechanism 22. In the preferred embodiment, the mounting face 30 and the trigger mounting surface 32 are perpendicular to each other. Other constructions are also possible within the scope of the invention. The mounting face 30 may be constructed to include an upwardly and outwardly extending arm, as shown in the preferred embodiment of FIG. 1. However, other shapes of the mounting face 30 could also be used effectively.

The mounting face 30 includes a large circular hole or cutout 34, surrounded by several smaller holes 36, and an elongate cutout 38. The trigger mounting surface 32 includes a substantially circular cutout 40 and an arc-shaped cutout 42. The arc-shaped cutout 42 may also be embodied as an arched slot or recess such that an opening is not made through the complete thickness of the mounting bracket 16. In the preferred embodiment, the mounting bracket 16 is constructed of a single machined piece of anodized aluminum. However, any material or combination of pieces may be used that will effect the same result.

The mounting bracket 16 is attached to the front side of bow 12 using a mounting screw or bolt 44 inserted through the elongate cutout 38 in the mounting face 30 of the mounting bracket 16. The elongate nature of the cutout 38 enables the mounting position of the bracket 16 to be adjusted vertically along the longitudinal axis of the bow 12. The front side of the bow 12 is defined to be that side of the bow 12 opposite the user of the bow 12 during use. The rear side of the bow 12 is defined to be that side closest to or facing the user of the bow during use.

The elongate rod 18 passes through the large circular cutout 34 in the mounting bracket 16. In the preferred embodiment, a flanged stabilizing sleeve 46 is mounted in the cutout 34 for receiving the rod 18. The stabilizing sleeve 46 is secured to the mounting bracket 16 using a plurality of flange screws 48 screwed into the smaller holes 36. The flange screws 48 secure the flanged stabilizing sleeve 46 to the mounting bracket 16 and also anchor the spring 28 against the flanged stabilizing sleeve 46, as described later herein. Alternative embodiments with different mounting and structure for the stabilizing sleeve, or even without any stabilizing sleeve, are possible within the intended scope of the present invention.

Beginning on the front side of the bow 12, the elongate rod 18 is inserted through the mounting bracket 16 and flanged stabilizing sleeve 46 such that a relatively small portion of the rod 18 remains protruding from the front side of the bow 12. The portion of the rod 18 that remains protruding from the front side of the bow 12 is hereinafter referred to as the rod forward end 50. For the purposes of defining all portions of the rod, the portion of the rod 18 remaining within the flanged stabilizing sleeve 46 shall be considered part of the rod forward end 50.

As shown in FIG. 1, the rod forward end 50 may include and terminate with a crank arm 52, the crank arm 52 oriented at or nearly transverse to the longitudinal axis of the rod 18. The tension element in the form of coiled spring 28 is mounted on the portion of the rod forward end 50 immediately adjacent the crank arm 52. The majority of the length of the elongate rod 18 extends from the rear side of the bow 12. The portion of the rod 18 that extends from the rear side of the bow 12 is hereinafter referred to as the rod rearward end 54. The rod forward end 50 and the rod rearward end 54 effectively meet at a circumferential recess 56. The circumferential recess 56 receives a clip 58. In the preferred embodiment, before the rod 18 is inserted through the flanged stabilizing sleeve 46, the coiled spring 28 is slid over the length of the rod 18, beginning at the free end of the rod rearward end 54. When the spring 28 is adjacent the crank arm 52, the rod 18 is inserted through the mounting bracket 16 from the front side of the bow 12, beginning with the free end of the rod rearward end 54. When the rod 18 is fully inserted through the flanged stabilizing sleeve 46, the recess 56 is adjacent the back of the flanged stabilizing sleeve 46 on the rear side of the bow 12. The clip 58 is then secured in the recess 56 to prevent the rod 18 from sliding back out on the front side of the bow 12.

The holding mechanism 20 is mounted on the rod rearward end 54 and has an engaged and a disengaged position. The holding mechanism 20 includes an adjustable collar 60, a hold-down arm 62, and structure for stabilizing the arrow. In the preferred embodiment, the structure for stabilizing the arrow is embodied as a separate end piece 64 for adjustment in close proximity to the arrow shaft 14. Alternatively, the structure for stabilizing may be the end of the hold-down arm 62 itself such that the holding mechanism 20 is constructed without a separate end piece, i.e., the end piece may be integral to the hold-down arm 62. As a further alternative, the structure for stabilizing may be embodied as one or more downwardly extending limbs, secured to the hold-down arm with a second adjustable collar or by other suitable means, as described later herein.

The adjustable collar 60 slides back and forth along the rod rearward end 54, making the precise mounting location of the holding mechanism 20 fully adjustable along the length of the rod rearward end 54. The collar 60 can also be rotated 360° around the rod 18, providing a full range of angular adjustment. Once adjusted to the desired location and angle, the collar 60 is secured to the selected point on the rod 18 using a locking device such as a set screw 66. Other means of securing the collar 60 are also possible, whether by tension, compression, or simply friction created by the fit of the collar 60 on the rod 18.

The hold-down arm 62 has a mounting end 68 and a holding end 70. The end piece 64 is mounted to the tip of the holding end 70. The mounting end 68 is connected to the collar 60. In the preferred embodiment, the mounting end 68 is inserted into a channel 72 in the collar 60. The ultimate distance between the end piece 64 and the collar 60 is adjustable through variation in the insertion depth of the mounting end 68 within the channel 72. The approach angle of the hold-down arm 62 is also adjustable through rotation of the arm about the longitudinal axis of the mounting end 68. Once the approach angle and insertion depth are adjusted as desired, the hold-down arm 62 is secured in the collar 60 at that approach angle and depth using a locking device such as a set screw 74. Again, other means of securing the hold-down arm 62 to the collar 60 may be employed, including non-adjustable means, without departing from the invention. In the preferred embodiment, the hold-down arm 62 is embodied as bendable wire, providing additional adjustability in the positioning of the end piece 64 and in the configuration of the hold-down arm 62.

The end piece 64 can be made of plastic or any other material suitable for interfacing with the shaft 14 of the arrow. When the holding mechanism 20 is in the engaged position, the end piece 64 is very close to the shaft 14 of the arrow but preferably does not actually make contact therewith. As the arrow is drawn back to shoot, the arrow shaft 14 passes just beneath the tip of the end piece 64. There is no contact between the tip of the end piece 64 and the arrow shaft 14 unless the arrow moves outside its intended path. This can happen either through tilting of the bow or as a result of a bad draw or release. When the arrow would otherwise move in an undesired direction, the tip comes into contact with the shaft 14 and, acting in conjunction with the fingers 76 of the rest 78, prevents such motion.

Alternatively, the hold-down arm 62 may be adjusted to put the end piece 64 into positive contact with the shaft 14 of the arrow, if desired. When so adjusted, the arrow may still be released effectively and accurately with the holding mechanism 20 engaged.

While the present invention is constructed to allow the shooter to rotate the holding mechanism 20 into the disengaged position just prior to shooting, the design and placement of the end piece 64 make it possible and even preferable to release the arrow with the holding mechanism 20 in the engaged position. Leaving the hold-down arm 62 engaged during the shot actually improves the odds of a good release. In the case of a bad release, the tip of the end piece 64 can help stabilize the flight path of a misfired arrow. When set up properly, the holding mechanism 20 has little or no influence on a correctly drawn and fired arrow. In any other case, it can only influence the arrow in a positive way.

The holding mechanism 20 of the present invention can accommodate the full range of arrow orientations that are possible when nocking an arrow to take a shot. More specifically, arrows are constructed with three veins, one of which is typically a different color. This different colored vein, or odd vein, is used to properly orient the nock of the arrow on the string. The holding mechanism 20 of the present invention may be adjusted to accommodate all three possible arrow positions, namely odd vein out, odd vein down, and odd vein up.

Figure 3A:
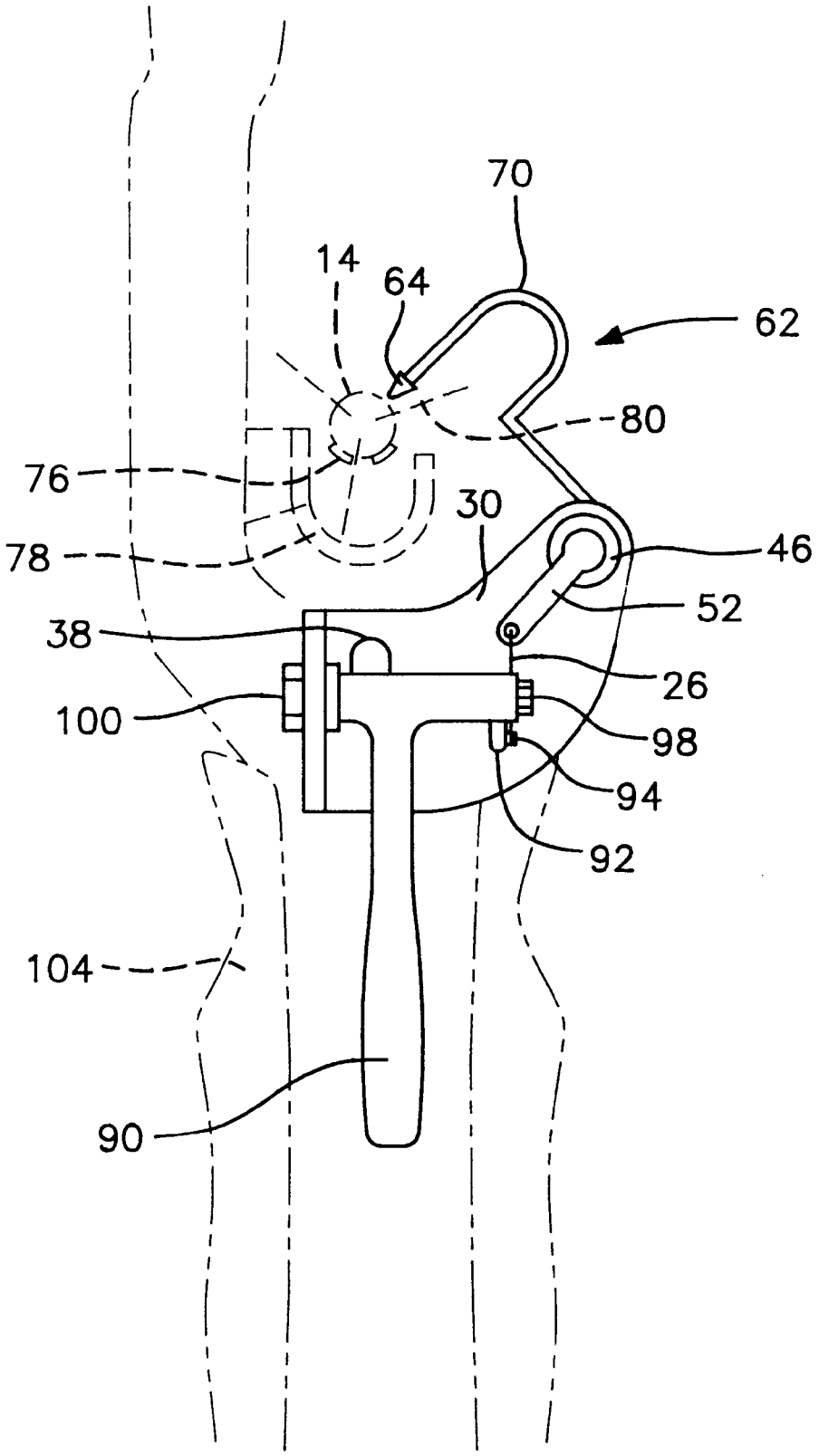
FIG. 3A is a front view of the hold-down arm in accordance with the present invention for an odd vein out configuration.
Figure 3B:
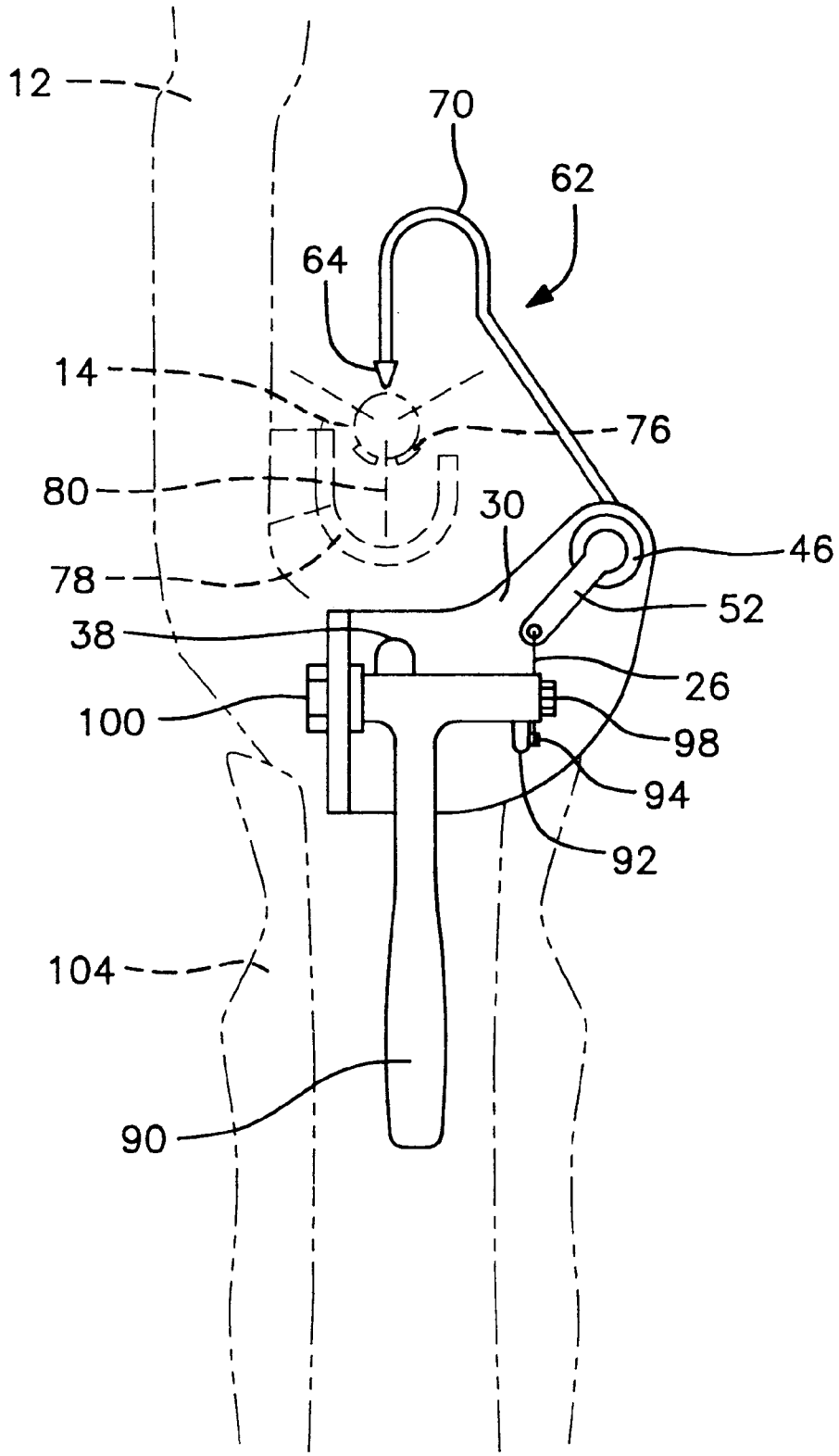
FIG. 3B is a front view of the hold-down arm in accordance with the present invention for an odd vein down configuration.

FIGS. 3A and 3B illustrate an odd vein 80 in the odd vein out and odd vein down configurations, respectively. As may be seen, the hold-down arm 62 arcs up and over the arrow shaft 14 to clear the veins of the arrow. The shaft 14 of the arrow rests on the fingers 76 of the bow rest 78. The tip of the end piece 64, when the holding mechanism 20 is in the engaged position, is just above the arrow shaft 14.

Figure 3C:
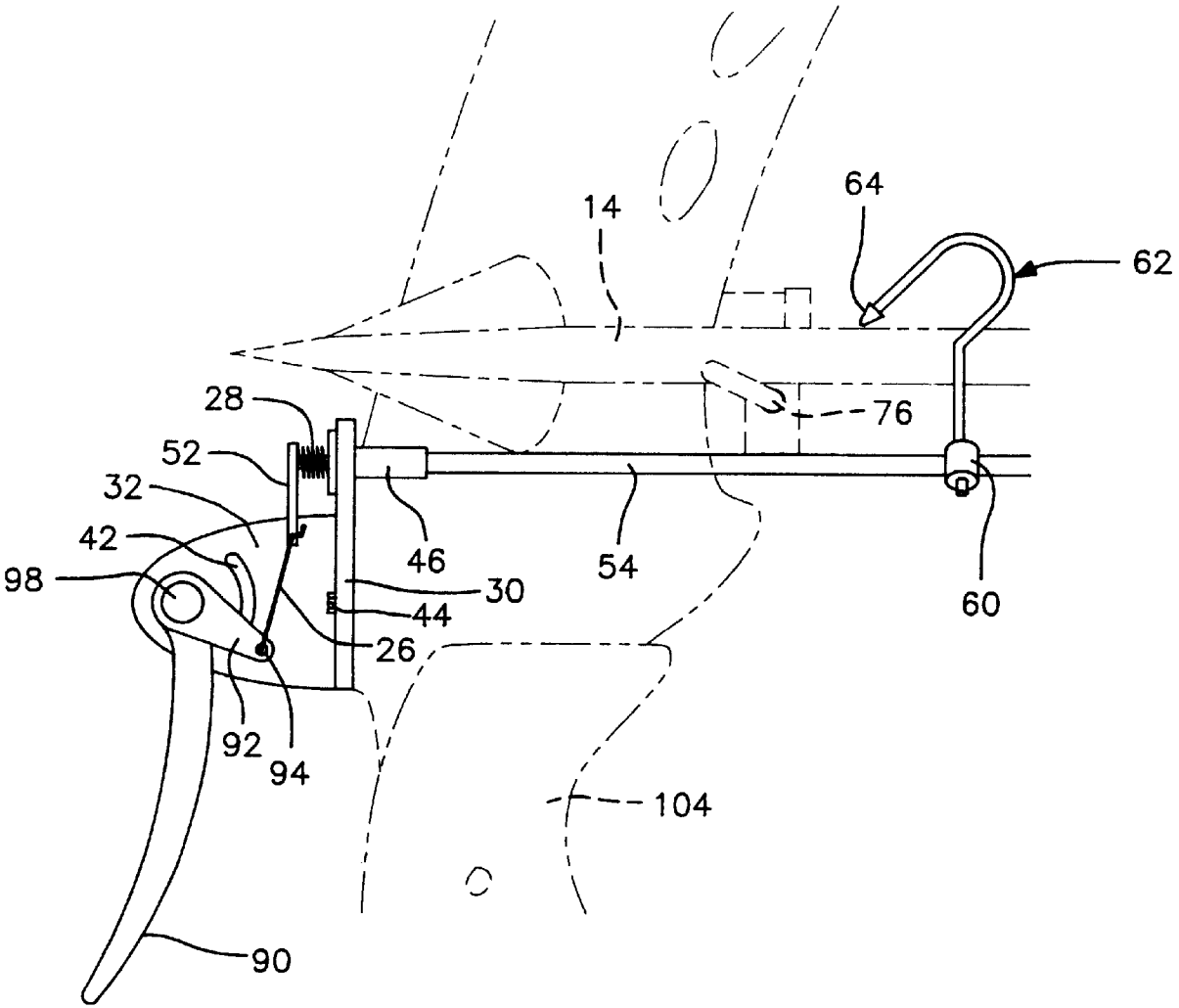
FIG. 3C is a side view of the hold-down arm in accordance with the present invention showing the preferred orientation of the arm relative to the arrow shaft.

FIG. 3C shows the preferred approach angle of the hold-down arm 62 when adjusted for use. As shown, this approach angle is best adjusted such that the tip of the end piece 64 approaches the arrow shaft 14 at an angle similar to the angle at which the fingers 76 of the arrow rest 78 meet the shaft 14. Of course, a wide range of adjustment is possible, responsive to the user's specific needs.

Figure 4A:
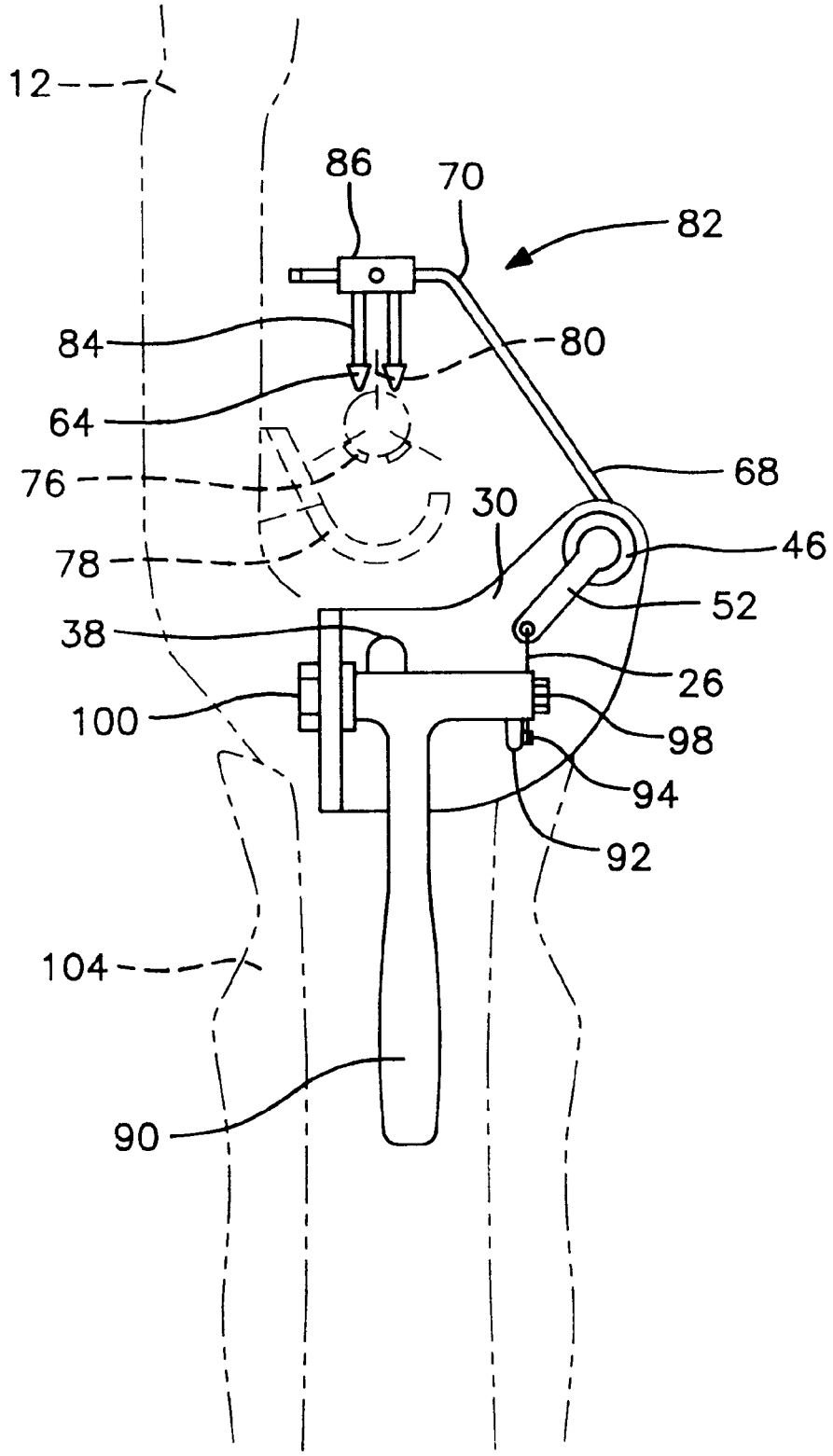
FIG. 4A is a front view of an alternative split limb construction of the hold-down arm in accordance with the present invention for an odd vein up arrow configuration.

FIG. 4A illustrates an odd vein 80 in the odd vein up configuration which is accommodated through the use of a split limb construction, generally designated by the reference numeral 82. The split limb construction 82 includes two downwardly and forwardly extending limbs 84. Each limb preferably includes an end piece 64, but this is not required. The limbs 84 are adjustably secured to the hold-down arm 62 using a second adjustable collar 86. The limbs 84 may have a unitary adjustment or may include individual adjustments for each limb within the collar 86. The collar 86 may be similar to the collar 60, and may include one or more set screws. Other means for securing the limbs 84 to the hold-down arm 62 could also be used. Alternatively, the limbs 84 could be constructed integral with the hold-down arm 62.

Figure 4B:
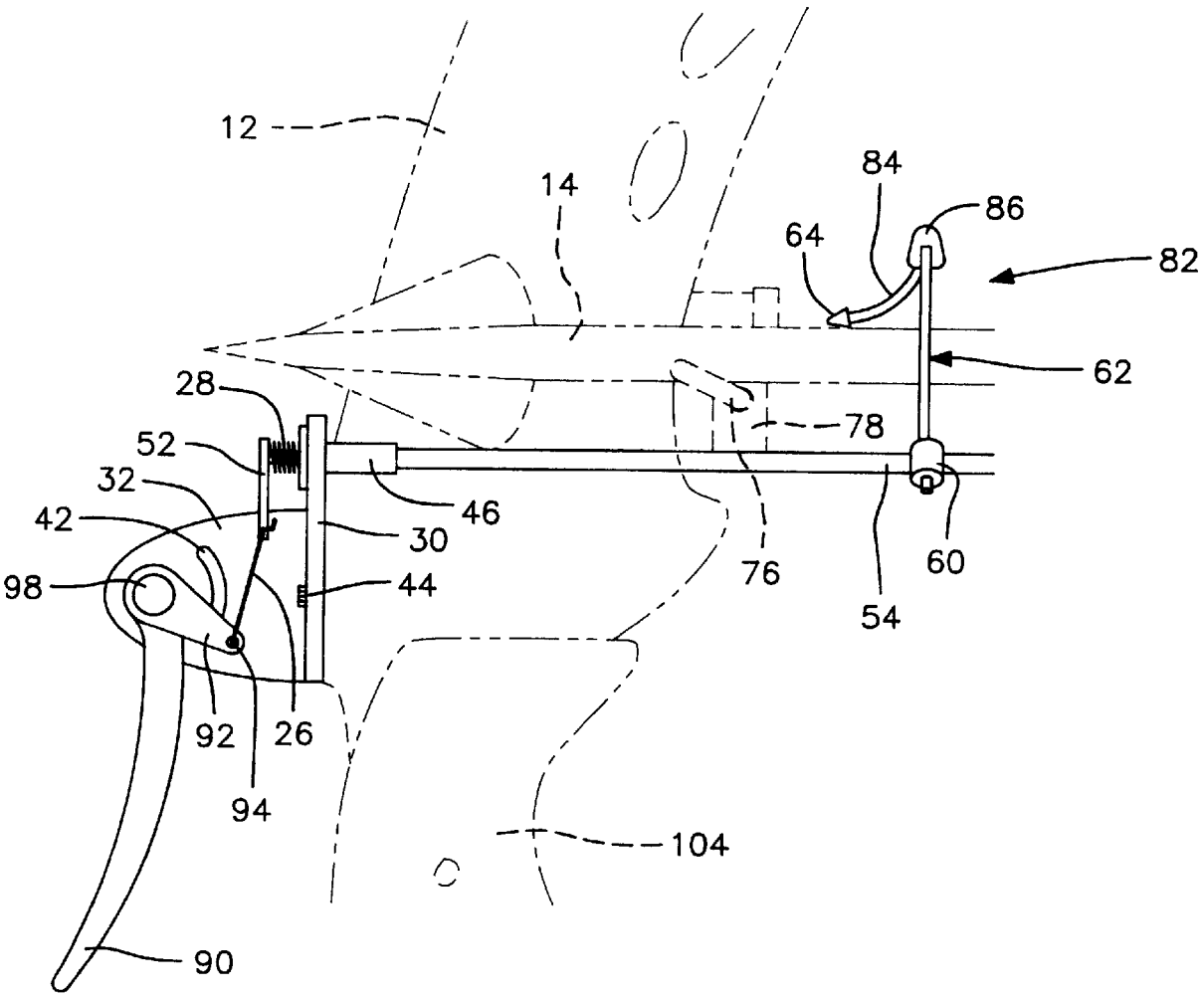
FIG. 4B is a side view of the alternative split limb construction of FIG. 4A.

FIG. 4B shows the preferred curvature of the split limbs 84 and the nature of the angle between the end pieces 64 and the shaft 14 of the arrow when the hold-down arm 62 and limbs 84 have been properly adjusted for use.

The trigger mechanism 22 is pivotally mounted to the trigger mounting surface 32 of the mounting bracket 16 and operatively coupled to the rod forward end 50. In the preferred embodiment shown in FIGS. 1 and 2, the trigger mechanism 22 includes a trigger 24, a push bar 26 and a spring 28. The trigger 24 has a pivoting axis 88, a downwardly extending trigger arm 90 and a rearwardly extending push arm 92. A ridged lug 94 protrudes from the distal end of the push arm 92.

The lower end of the push bar 26 is characterized by a circular portion or loop. The ridged lug 94 is inserted through the loop of the push bar 26. A clip 96 is then snapped onto the ridge of the lug 94, thus securing the lower end of the push bar 26 against the push arm 92.

The upper end of the push bar 26 is operatively coupled to the rod forward end 50. In the preferred embodiment the push bar 26 is bent near the upper end. The bent portion is inserted through a small opening in the crank arm 52 of the rod forward end 50. The bend engages the crank arm 52 and prevents the push bar 26 from simply passing through the opening in the crank arm 52 when upward pressure is applied.

The trigger 24 is mounted to the trigger mounting surface 32 through the pivoting axis 88 using a trigger screw 98 and a lock nut 100. A washer 102 is inserted between the head of the trigger screw 98 and the trigger 24. The trigger 24 is pivotally mounted for angular displacement between an at rest position and a pulled position. In the pulled position the distal end of the trigger arm 90 is closer to the grip 104 of the bow 12 than in the at rest position.

Figure 5A:
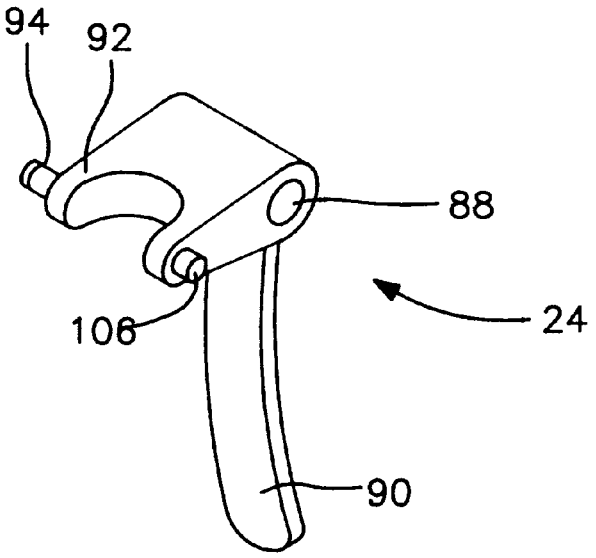
FIG. 5A is a perspective view of the trigger, in accordance with the present invention, showing the travel stop pin.
Figure 5B:
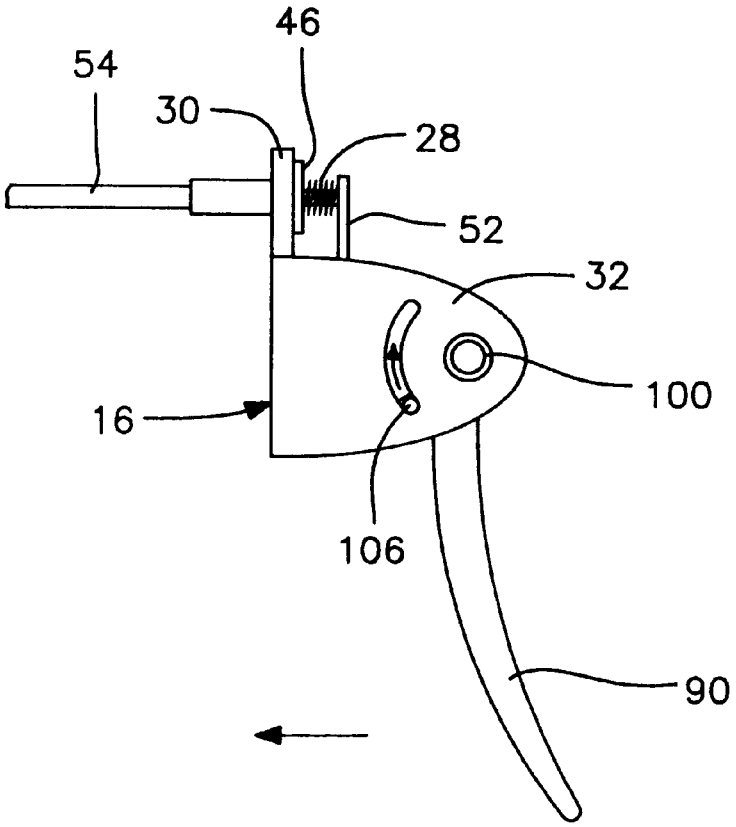
FIG. 5B is a side view of the mounting bracket, from the outer side of the trigger mounting surface, in accordance with the present invention, showing the trigger in the at rest position and the travel stop pin in the lowermost end of the arc-shaped cutout.

As shown in FIG. 5A, the trigger 24 also includes a travel stop pin 106 which protrudes from that side of the trigger 24 adjacent the trigger mounting surface 32. The travel stop pin 106 is engaged within the arc-shaped cutout 42 on the trigger mounting surface 32. As shown in FIG. 5B, when the trigger 24 is in the at rest position, the pin 106 is situated, and stopped from further downward travel, in a lowermost point in the cutout 42. As indicated by the arrows in FIG. 5B, when the trigger 24 is pulled rearward into the pulled position, the pin 106, responsive to the rotation of the trigger, moves upwardly, in alignment with the curvature of the cutout 42. When the trigger 24 reaches the pulled position, the pin 106 is situated, and stopped from further upward travel, in an uppermost point in the cutout 42. Thus, the pin 106, in cooperation with the cutout 42, securely stops the trigger 24 at both ends of its travel, improving the stability and accuracy of the adjustments made to the hold-down arm 62.

The trigger 24 is biased to the at rest position by the tension element. In the preferred embodiment, the tension element is embodied as coiled spring 28 mounted so as to encircle the rod forward end 50. However, any highly resilient material could be used in place of the spring 28, such as a stretchable band, with alternative methods of mounting.

One end of the spring 28 curls around the shaft of one flange screw 48 and is anchored against the flanged stabilizing sleeve 46 when that flange screw 48 is installed. The other end of the spring 28 is connected to the crank arm 52 of the rod forward end 50. The spring 28 biases the holding mechanism 20 into the engaged position and the trigger 24 into the at rest position. Tension in the coiled spring 28 can be adjusted by selecting the desired flange screw 48 for attachment.

Pivoting of the trigger mechanism 22 into the pulled position forces the push bar 26 upward. The push bar 26 acts on the crank arm 52 to exert compression force on the spring 28. The upward movement of the push bar 26 is converted to rotation of the elongate rod 18, the rotation being clockwise as viewed from the frontal aspect of the bow 12 as depicted in FIG. 1. The collar 60, hold-down arm 62 and end piece 64 turn with the rod 18, rotating the holding mechanism 20 clockwise into the disengaged position away from the arrow shaft 14. The direction of rotation of the rod 18 and holding mechanism 20 would be counterclockwise from this viewing perspective in the case of an arrow stabilizing mechanism 10 made for a left-handed bow.

Figure 6:
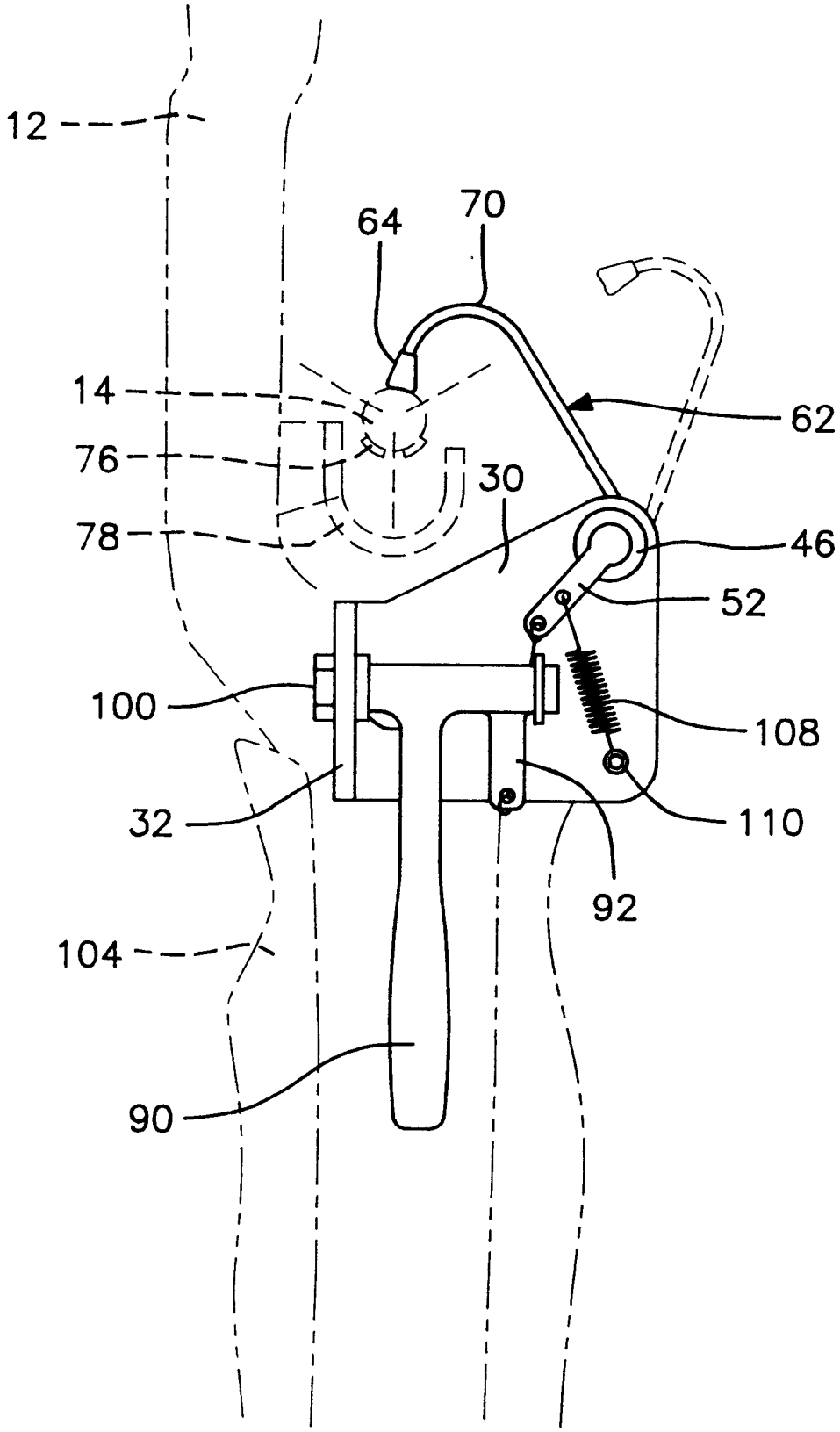
FIG. 6 is a front view of an alternative embodiment of the present invention.
Figure 7:
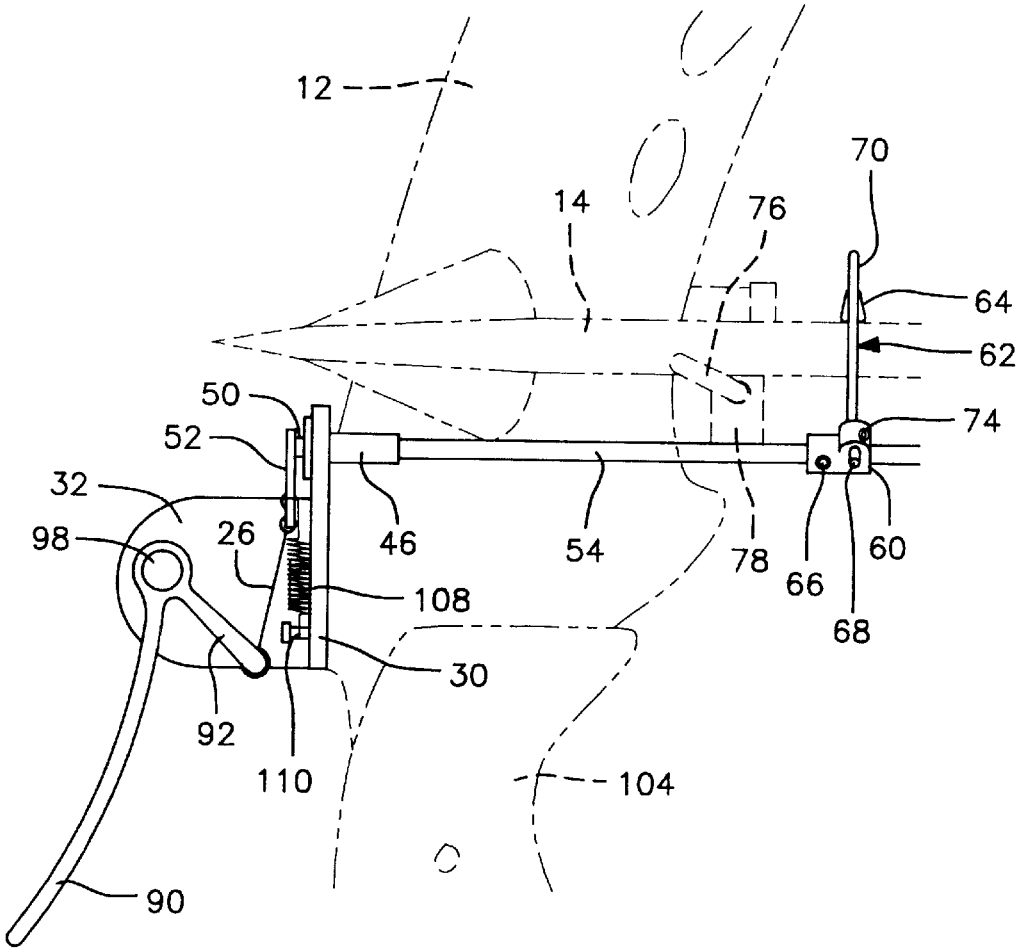
FIG. 7 is a side view of the alternative embodiment shown in FIG. 6.
Figure 8:
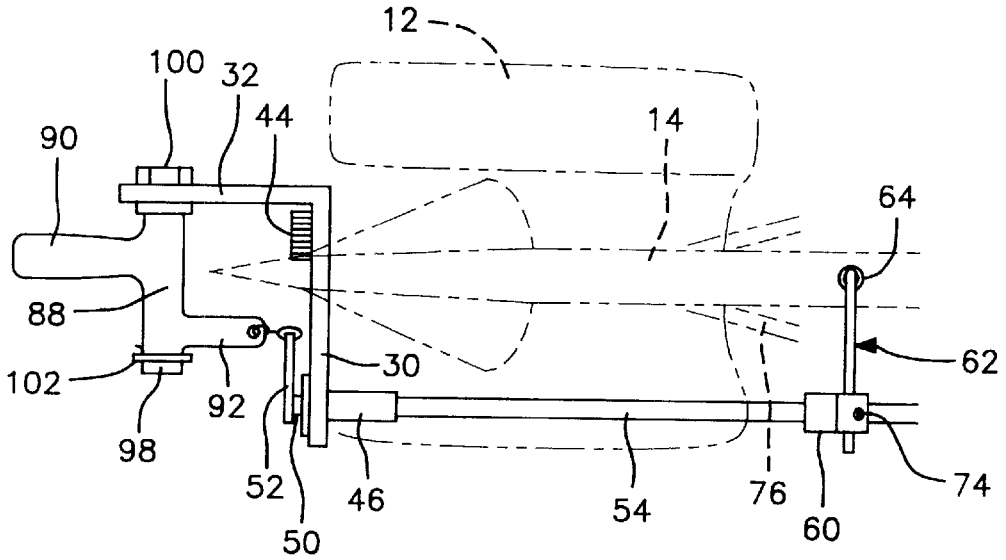
FIG. 8 is a top view of the alternative embodiment of FIG. 6.

As shown in an alternative embodiment illustrated in FIGS. 6, 7 and 8, the tension element may be in the form of a tension spring 108. In this embodiment, the tension spring 108 is connected at one end to a connecting structure, such as a bolt 110, 710 mounted on the mounting bracket 16 and at the other end to the crank arm 52 of the rod forward end 50. The spring 108 biases the holding mechanism 20 into the engaged position and the trigger 24 into the at rest position. Pivoting of the trigger mechanism 22 into the pulled position forces the push bar 26 upward and exerts elongating force on the tension spring 108. The upward movement of the push bar 26 is converted to rotation of the elongate rod 18, the rotation being clockwise as viewed from the front of the bow 12 as depicted in FIG. 6. The collar 60, hold-down arm 62 and end piece 64 turn with the rod 18, rotating the holding mechanism 20 clockwise into the disengaged position, shown by phantom lines. The direction of rotation of the rod 18 and holding mechanism 20 would be counterclockwise from this viewing perspective in the case of an arrow stabilizing mechanism made for a left-handed bow. In the embodiment shown in FIGS. 6, 7 and 8, the hold-down arm 62 has been adjusted so that the end piece 64 is in contact with the arrow shaft 14.

The linkage between the trigger mechanism 22 and the elongate rod 18 may include other variations in construction and is not limited to the specific embodiments shown. Furthermore, as would be known by one of skill in the art, with adjustment to the nature or shape of the push arm 92 and/or the crank arm 52, an operational linkage between the trigger 24 and the elongate rod 18 could be constructed, i.e., a linkage without push bar 26, in accordance with the present invention.

FIG. 7 shows a side view of the alternative embodiment of FIG. 6 as mounted on a bow 12. Limited portions of the bow and an arrow at full draw are shown with phantom lines. FIG. 8 depicts a top view of the same arrangement. In both figures, the trigger 24 is in the at rest position and the holding mechanism 20 is in the engaged position. These figures also illustrate an alternative adjustment configuration of the hold-down arm 62, with the end piece 64 in contact with the arrow shaft 14 and nearly perpendicular thereto.

When using the present invention, the user would initially mount and adjust the arrow stabilizing mechanism 10 to fit his or her particular bow configuration. The first step is to secure the mounting bracket 16 to the front face of the bow 12 using the mounting screw or bolt 44. As previously described, the elongate cutout 38 in the mounting face 30 allows the user to adjust the placement of the bracket 16 along the longitudinal axis of bow 12.

Once the bracket 16 has been mounted, the user then inserts the flanged stabilizing sleeve 46 into the large circular cutout 34 and secures it with flange screws 48 in the smaller holes 36. The spring 28 is slid onto the rod 18, and the rod 18 is inserted through the stabilizing sleeve 46 and secured with the clip 58 in the recess 56. One end of the spring 28 is secured to the stabilizing sleeve 46 with a flange screw 48, and the other end of the spring 28 is secured to the crank arm 52. If the trigger 24 is not already attached to the trigger mounting surface 32, it is secured thereto using the bolt 98 and nut 100, taking care that the travel stop pin 106 is engaged within the arched cutout 42. The lower end of the push bar 26 is mounted to the ridged lug 94 and secured with the clip 96. The upper end of the push bar 26 is inserted into the opening in the crank arm 52.

The user then slides the collar 60 back and forth along the rod rearward end 54 until the holding mechanism 20 is positioned at the desired location on the longitudinal axis of the rod 18. The angle of the collar 60 on the rod 18 is also adjusted. When the location and angle have been determined, the collar 60 is secured at that point and orientation on the rod 18 using set screw 66.

The user can then make adjustments to the insertion depth and approach angle of the hold-down arm 62 within the collar 60. These adjustments enable the user to precisely control the placement of the end piece 64 relative to the arrow shaft 14. When the desired approach angle of the hold-down arm 62 and distance between the end piece 64 and the collar 60 have been determined, the hold-down arm 62 is locked in the collar 60 at that approach angle and insertion depth using set screw 74. Finally, the user can fine-tune the shape and orientation of the hold-down arm by physically bending the hold-down arm 62 as desired.

In the case of the split limb construction 82 as illustrated in FIGS. 5A and 5B, the user can adjust the length of the downwardly extending limbs 84 through adjustment of the depth of their insertion into the second adjustable collar 86. The angle and bend of the limbs 84 can also be adjusted by rotating the collar 86 around the hold-down arm 62 and/or by bending the limbs 84 themselves. The limbs 84 may have a unitary adjustment or may include individual adjustments for each limb.

Once the arrow stabilizing mechanism has been initially configured to accommodate the particular bow setup of the user, it is ready to receive an arrow. Grasping the bow at the grip 104, the user extends one or more fingers on the grip hand to curl about the trigger arm 90. Closing these fingers to squeeze the trigger arm 90 toward the grip 104, the user causes the trigger 24 to pivot into the pulled position, which rotates the holding mechanism 20 into the disengaged position. The user then nocks the rear of the arrow on the bowstring and rests the forward portion of the arrow shaft 14 on whatever arrow rest the user has installed. Next, the user releases the trigger arm 90, allowing it to return to the at rest position which, in turn, allows the holding mechanism 20 to rotate back into the engaged position. As the holding mechanism 20 rotates into the engaged position, the end piece 64 comes into very close proximity with the shaft 14 of the arrow. The arrow is effectively secured between the fingers 76 of the arrow rest 78 and the tip of the end piece 64. The user can hold the bow and arrow as a unit with only a light and comfortable grip of the hand on the bow grip 104. If the arrow begins to move upward, it immediately comes into contact with the end piece 64, thus preventing any further movement. The bow can be swung through a full range of movement without risk of the arrow falling from the rest.

If, when the time comes to shoot, the user wishes to disengage the arrow stabilizing mechanism 10, the user simply uncurls one or more fingers on the bow grip 104 to extend forward and encircle the trigger arm 90. This action may be taken at any time, whether before or after drawing the bow to full draw. By squeezing in on the trigger arm 90, the user can silently disengage the holding mechanism 20 just prior to releasing the arrow. Of course, the user may decide to disengage the holding mechanism 20 at an earlier point in time if desired. In either case, if the user decides not to shoot, the holding mechanism 20 can be silently reengaged simply by releasing the pressure of the fingers on the trigger arm 90.

It is the intent of the present invention, however, to keep the holding mechanism 20 engaged for as long as possible as this maximizes safety and shot accuracy by securing the arrow against the bow 12. Furthermore, in the preferred embodiment, it is intended that the holding mechanism 20 be left in the engaged position, both before and during the shot. As already explained, the design of the holding mechanism 20 does not interfere with the fletching of the arrow and, when engaged, can improve the user's chances of a good release. Misfired arrows are stabilized by the mechanism, and well fired arrows are not adversely affected by the engaged hold-down arm 62.

The foregoing descriptions and drawings should be considered as illustrative only of the principles of the invention. Therefore, it is not desired to limit the invention to the specific examples disclosed or the exact construction and operation shown and described. Rather, all suitable modifications and equivalents may be resorted to, falling within the scope of the invention.

What is claimed is:

1. An arrow stabilizing mechanism for use with a bow and arrow, the bow having a rear side nearest a user of the bow and a front side opposite the rear side, the mechanism comprising:

a mounting bracket having a mounting face and a trigger mounting surface, said mounting face for attaching said mounting bracket to the bow;

an elongate rod mounted through said mounting face and having a rearward end projecting from the rear side of the bow and a forward end projecting from the front side of the bow;

a holding mechanism mounted on the rearward end of said rod, said holding mechanism having an engaged position and a disengaged position, the engaged position for stabilizing an arrow on the bow; and a trigger mechanism for rotating said holding mechanism between the engaged position and the disengaged position, said trigger mechanism including, a trigger pivotally mounted to the trigger mounting surface of said mounting bracket, for angular displacement between an at rest position and a pulled position, and connected to the forward end of said rod; and a tension element for biasing said holding mechanism into the engaged position and said trigger into the at rest position, wherein pivoting of said trigger into the pulled position rotates said holding mechanism into the disengaged position.

2. The arrow stabilizing mechanism as set forth in claim 1, said tension element comprising a coiled spring mounted on the forward end of said rod, a first end of said coiled spring anchored to said mounting face and a second end of said coiled spring connected to a crank arm on the forward end of said rod.

3. The arrow stabilizing mechanism as set forth in claim 1, said tension element comprising a tension spring attached at a first end to said mounting face and attached at a second end to a crank arm on the forward end of said rod.

4. The arrow stabilizing mechanism as set forth in claim 1, said holding mechanism comprising:

an adjustable collar, slidingly mounted on the rearward end of said rod, said collar having a channel, a first set screw and a second set screw, said collar secured to said rod with the first set screw; and a hold-down arm having a mounting end and a holding end, the mounting end adjustably inserted into the channel and secured therein with the second set screw, and the holding end stabilizing the arrow when said holding mechanism is in the engaged position.

5. The arrow stabilizing mechanism as set forth in claim 4, further comprising an end piece, mounted on the holding end of said hold-down arm, for interfacing with and stabilizing the arrow.

6. The arrow stabilizing mechanism as set forth in claim 4, further comprising:

a second adjustable collar connected to the holding end of said hold-down arm; and two downwardly extending limbs, adjustably secured to said second collar, for interfacing with and providing two points of stabilization to the arrow.

7. The arrow stabilizing mechanism as set forth in claim 1, said mounting face including an elongate opening through which a bolt is inserted for adjustably attaching, along a longitudinal axis of the bow, said mounting bracket to the bow.

8. The arrow stabilizing mechanism as set forth in claim 1, wherein said trigger further includes a travel stop pin, said travel stop pin engaged within an arc-shaped cutout in said trigger mounting surface such that, when said trigger is in the at rest position, the travel stop pin is situated, and stopped from further downward travel, in a lowermost point in the cutout and, when said trigger is in the pulled position, the travel stop pin is situated, and stopped from further upward travel, in an uppermost point in the cutout.

9. The arrow stabilizing mechanism as set forth in claim 1, further comprising a stabilizing sleeve passing through and rigid with said mounting bracket for receiving said rod therethrough.

10. The arrow stabilizing mechanism as set forth in claim 1, further comprising a push bar connected at a lower end to said trigger and at an upper end to the forward end of said rod.

11. An arrow stabilizing mechanism for use with a bow and arrow, the bow having a rear side nearest a user of the bow and a front side opposite the rear side, the mechanism comprising:

a mounting bracket having a mounting face and a trigger mounting surface, the mounting face including an elongate opening through which a bolt is inserted for attaching said mounting bracket to the front side of the bow, the elongate opening allowing adjustable positioning of said mounting bracket along a longitudinal axis of the bow;

an elongate rod mounted through said mounting face, said elongate rod having a rearward end projecting from the rear side of the bow and a forward end projecting from the front side of the bow, the forward projecting end having a crank arm;

a holding mechanism having an engaged position and a disengaged position, said holding mechanism including a collar and a hold-down arm with a first end and a second end, the collar adjustably mounted on the rearward end of the elongate rod, the first end of the hold-down arm adjustably mounted in the collar, and the second end of the hold-down arm in close association with the arrow when said holding mechanism is in the engaged position;

a trigger, pivotally mounted to said trigger mounting surface to allow angular displacement between an at rest position and a pulled position and connected to the crank arm, for rotating said holding mechanism between the engaged position and the disengaged position; and a spring, mounted on the forward end of said rod and having one end attached to the crank arm and a second end attached to said mounting bracket, said spring for biasing said holding mechanism into the engaged position and said trigger into the at rest position, wherein pivoting of said trigger into the pulled position rotates said holding mechanism into the disengaged position.

12. The arrow stabilizing mechanism as set forth in claim 11 wherein the second end of said hold-down arm further includes:

an end piece, mounted on a tip of the second end of said hold-down arm, for stabilizing the arrow.

13. The arrow stabilizing mechanism as set forth in claim 11 wherein the second end of said hold-down arm further includes:

a second adjustable collar connected near the second end of said hold-down arm; and two downwardly extending limbs adjustably secured at upper ends to said second collar, and at lower ends providing two points of stabilization to the arrow.

14. The arrow stabilizing mechanism as set forth in claim 11, further comprising a flanged stabilizing sleeve connected to said mounting bracket and receiving said rod therethrough.

15. The arrow stabilizing mechanism as set forth in claim 11, further comprising a push bar connected at a lower end to said trigger and at an upper end to the crank arm.

16. The arrow stabilizing mechanism as set forth in claim 11, said mounting face including an arched slot and said trigger including a travel stop pin for engaging within the arched slot such that, when said trigger is in the at rest position, the travel stop pin is situated, and stopped from further downward travel, in a lowermost point in the slot and, when said trigger is in the pulled position, the travel stop pin is situated, and stopped from further upward travel, in an uppermost point in the slot.

* * * * *